US008037661B2

(12) United States Patent
Albert et al.

(10) Patent No.: US 8,037,661 B2
(45) Date of Patent: Oct. 18, 2011

(54) SHUTTLE CHANGE SYSTEM AND METHOD FOR WRAPPING APPARATUS

(75) Inventors: Leonid M. Albert, Skokie, IL (US); Jeffrey G. Kellermann, Arlington Heights, IL (US)

(73) Assignee: Illinois Tool Works Inc., Glenview, IL (US)

( * ) Notice: Subject to any disclaimer, the term of this patent is extended or adjusted under 35 U.S.C. 154(b) by 761 days.

(21) Appl. No.: 11/953,993

(22) Filed: Dec. 11, 2007

(65) Prior Publication Data

US 2008/0168643 A1 Jul. 17, 2008

Related U.S. Application Data

(60) Provisional application No. 60/884,822, filed on Jan. 12, 2007.

(51) Int. Cl.
*B65B 25/24* (2006.01)

(52) U.S. Cl. ..... 53/409; 53/204; 53/588; 29/700; 100/12; 100/13; 100/27

(58) Field of Classification Search ..... 53/203, 53/204, 210, 211, 389.4, 409, 556, 587, 588; 29/700; 100/12, 13, 27
See application file for complete search history.

(56) References Cited

U.S. PATENT DOCUMENTS

| | | | | |
|---|---|---|---|---|
| 5,282,347 | A * | 2/1994 | Cleine et al. | 53/204 |
| 5,755,083 | A * | 5/1998 | Cleine | 53/588 |
| 5,829,234 | A * | 11/1998 | Suolahti | 53/556 |
| 6,305,145 | B2 * | 10/2001 | Suolahti | 53/64 |
| 6,446,418 | B1 * | 9/2002 | Maekawa et al. | 53/588 |
| 6,520,445 | B2 * | 2/2003 | Araujo | 242/434.5 |
| 6,688,076 | B1 * | 2/2004 | Rivera, Jr. | 53/204 |
| 6,775,961 | B2 * | 8/2004 | Cook et al. | 53/556 |
| 6,851,252 | B2 | 2/2005 | Maki-Rahkola et al. | |
| 7,134,260 | B2 * | 11/2006 | Haloila | 53/588 |
| 7,757,463 | B2 * | 7/2010 | Bohl | 53/449 |
| 2010/0257816 | A1 * | 10/2010 | Albert et al. | 53/204 |

FOREIGN PATENT DOCUMENTS

| | | | |
|---|---|---|---|
| CN | 1225881 | A | 8/1999 |
| CN | 2590874 | Y | 12/2003 |
| EP | 0544312 | A1 | 6/1993 |

* cited by examiner

*Primary Examiner* — Thanh K Truong
(74) *Attorney, Agent, or Firm* — Levenfeld Pearlstein, LLC

(57) ABSTRACT

A shuttle change system for use in a wrapping apparatus for wrapping an associated item is disclosed. The wrapping apparatus includes a shuttle that moves along the inner periphery of a track dispensing a wrapping material. The shuttle change system includes a carrier and a pair of track sections mounted to the carrier. The track sections are spaced from one another and parallel to one another, each adapted to support a shuttle. The carrier is moveable vertically, longitudinally and laterally to align either of the pair of tracks with the cantilevered base portion of the track. One of the tracks is adapted to receive a shuttle to be replaced and the other of the tracks is adapted to store a replacement shuttle for movement onto the track. The carrier is movable away from the track to permit the openable track portion to open and close without interference.

17 Claims, 10 Drawing Sheets

SHUTTLE CHANGE SYSTEM AND METHOD FOR WRAPPING APPARATUS

BACKGROUND OF THE INVENTION

The present invention relates to a wrapping apparatus and more particularly to a shuttle or wrapping material carrier change system and method for a wrapping apparatus.

Certain items are packaged in roll or coil form. For example, steel and aluminum sheet are often coiled for storage, transport, and handling. Such coils can be up to five to seven feet in diameter.

In order to protect and preserve the appearance of the steel or aluminum, the coils are typically wrapped with protective material in the form of a film. Such a film can be a single wrap of, for example, a low density polyethylene stretch film. The wrap can also include a fabric or other woven or non-woven material wrapped along with the polyethylene film.

One known machine for carrying out the wrapping process uses a specifically shaped track to carry a film dispensing shuttle through the eye of the coil, while the coil is slowly rotated on its axis on a set of block rollers. The complete body of the coil is effectively sealed by a cocoon of stretch film.

Generally, the machine has a heavy-duty, generally oval shaped track that provides the guide for the film-dispensing shuttle that travels around the inside of the track. The track has a hinged end section or arm that pivots upwardly to open the track so that a lower portion of the track can be moved into the eye of the coil. The track is adjustable in the vertical plane to accommodate different coil diameters.

The track is typically movable on rails to advance into the eye of the coil. The machine can also be movable transverse to the direction of the track. Such a machine is commercially available from ITW Fleetwood-Signode of Glenview, Ill., under the name CoilMaster.

The film dispensing shuttle is designed to drive itself around the track. In a present system the shuttle includes a drive element (referred to as a tractor) and one or more film dispensing elements (each referred to as a trailer). The tractor and trailers are separate from, but operably connected to one another such that the tractor drives (pulls) the one or more trailers, and so that the tractor and trailer(s) can be separated from each other for maintenance, repair, replacement or the like.

The film is provided on the shuttle in rolls. The rolls have a finite amount of material wound thereon and as such require periodic replacement. Depending upon the size of the coil, a roll of film can last for perhaps as few as two or three coils. As such, the film rolls on the shuttle may have to be replaced fairly frequently. In known machines, the task of replacing the film and the shuttles is labor intensive and time consuming, thus quite costly.

To replace a film roll, the machine has to be shut down and the hinged track end opened. If a "tail" of the film is hanging from the coil, the tail is tucked into the wound film to prevent the tail from interfering with movement of the shuttle. The shuttle is positioned along the track at a predetermined location and the track is then withdrawn from the coil.

Following withdrawal of the track, a film roll is replaced in the shuttle. The track is then moved back into place in the eye of the coil, the hinged end is lowered and the track is closed. A leading end of the film is secured and the shuttle is restarted. Given that these machines are quite large, the entire film roll replacement procedure takes a considerable amount of time and requires a considerable amount of labor.

Accordingly, there is a need for a system and method for changing out a shuttle that precludes the need to remove the track from the eye of the coil. Desirably, such a system and method are carried out with the track in place in the coil. More desirably, such a system and method uses a ready substitute shuttle to further reduce the downtime necessary to place the machine back into service.

BRIEF SUMMARY OF THE INVENTION

A shuttle change system for use in a wrapping apparatus for wrapping an associated item is disclosed. The wrapping apparatus has an oval track vertically oriented with a cantilevered base portion and an openable portion in the track to move the item into and out of the track. The wrapping apparatus includes a shuttle that moves along the inner periphery of the track dispensing a wrapping material. The shuttle change system includes a carrier and a pair of track sections mounted to the carrier. The track sections are spaced from one another and parallel to one another, each adapted to support a shuttle. The carrier is moveable vertically, longitudinally, and laterally to align either of the pair of tracks with the cantilevered base portion of the track. One of the tracks is adapted to receive a shuttle to be replaced and the other of the tracks is adapted to store a replacement shuttle for movement onto the track. The carrier is movable away from the track to permit the openable track portion to open and close without interference.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DESCRIPTION OF THE INVENTION

While the present invention is susceptible of embodiment in various forms, there is shown in the figures and will hereinafter be described a presently preferred embodiment with the understanding that the present disclosure is to be considered an exemplification of the invention and is not intended to limit the invention to the specific embodiment illustrated.

Figure 1:
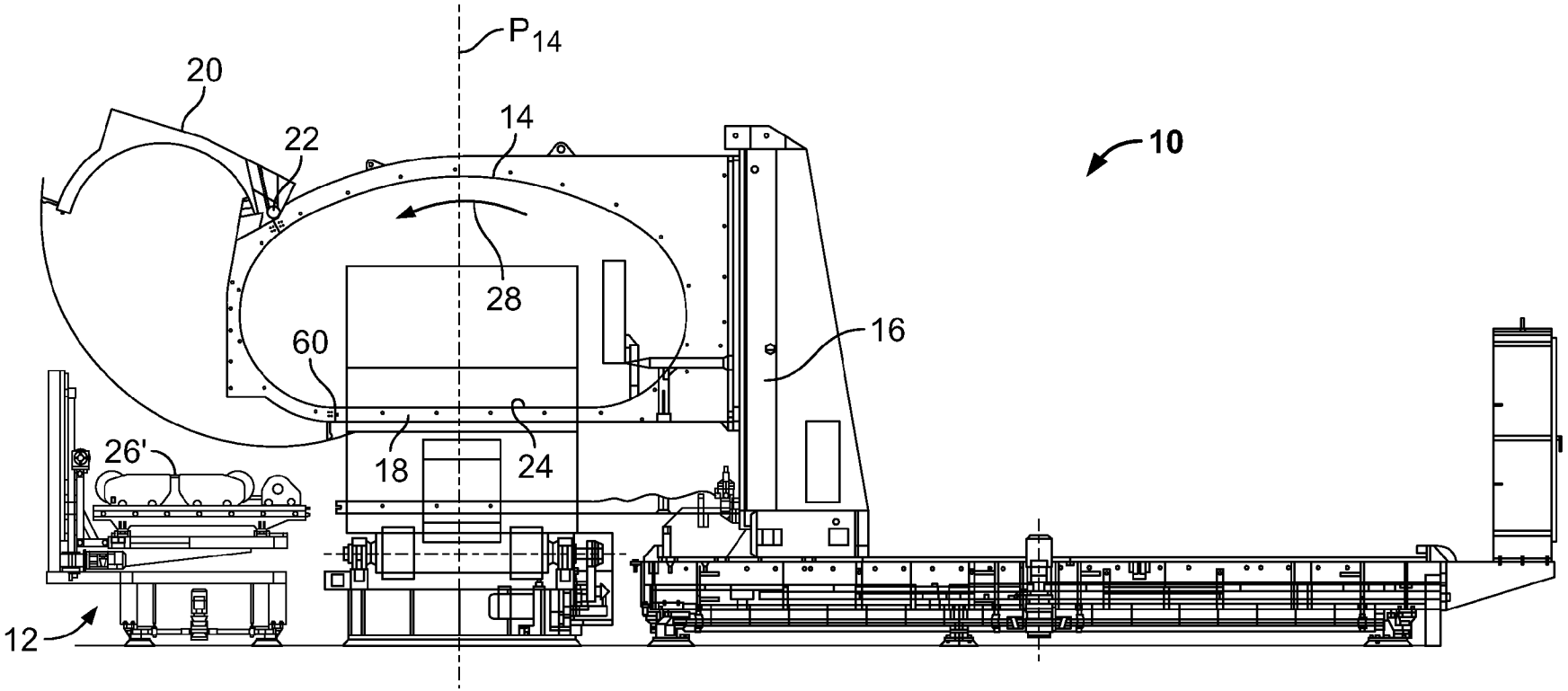
FIG. 1 is a side view of a wrapping apparatus having a shuttle change system in accordance with the principles of the present invent.

Referring to the figures and in particular to FIG. 1 there is shown a wrapping apparatus or machine 10 having a shuttle change system 12 and carrying out a method for shuttle change embodying the principles of the present invention.

The machine 10 includes a track 14 having a generally oval shape. A lower portion 18 of the track 14 is cantilevered when the arm 20 is open. An end (or arm) 20 of the oval is hinged opposite of the base 16 (with the hinge 22 at about the top of the track 14) to permit the track to be opened. When closed, the arm 20 aligns with the lower portion 18 of the track 14. The inside or inner periphery 24 of the track 14 thus defines a substantially continuous track. The track 14 moves up and down to accommodate coils C of different diameters.

A shuttle 26 is configured for movement along the inner periphery 24 of the track 14 in the direction indicated by the arrow at 28. The shuttle 26 includes, in a present embodiment, a drive or tractor 30, and a pair of film dispensing cars or 32*a,b* trailers that are pulled along by the tractor 30. Each of the trailers 32 dispenses either a polymer film, e.g., a low density polyethylene film or a fabric or like wrapping member, collectively referred to as film or films F. It should be noted that FIGS. 4-9 show a tractor that is integral with the trailer.

The change system 12 is configured to permit removing the shuttle 26 from the track 14 and replacing the shuttle 26 with a ready, stand-by or replacement shuttle 26' (see FIG. 1), with the track 14 in place in the eye E of the coil C. In fact, of the track 14 itself, only the arm section 20 of the track 14 has to be moved (i.e., opened) in order to effect a change of the shuttle 26. In addition, the shuttle 26 can be changed with a coil in place in the wrapping machine 10.

The change system 12 includes an assembly 36 having at least a pair of side-by-side track sections 38*a,b* on which the shuttle 26 can ride. The change system track sections 38 are oriented parallel to the machine track 14. In a present embodiment, the change system sections 38*a,b* are mounted to a carrier 40 that is adjustable in a number of planes. First, the change system track sections 38 height can be adjusted to match that of the machine track 14 (which can be positioned at different elevations depending upon the outside diameter of the coil C being wrapped. The longitudinal orientation (as indicated by the arrow at 42) can be changed to move the track sections 38 toward and away from the machine track 14, and the track sections 38 can be moved laterally or transverse (as indicated by the arrow at 44) to the machine track 14 direction so that the change system track sections 38 can align with the machine track 14. A winder element 46 is associated with each set of track sections 38 that, as will be discussed below, winds a portion of the film or films F after a new shuttle 26' has been positioned on the track 14, but before it is placed in service, to remove any excess film(s) or film tail from the track 14 surface.

As set forth above, the change system 12 includes at least a pair of track sections 38*a,b*. In this manner, a replacement shuttle 26' can reside on one of the track sections, for example, 38*a*, and the other track section 38*b* can be vacant. As will be discussed in more detail below, and as will be appreciated, the to-be-replaced shuttle 26 can be moved onto the vacant track section 38*b* and the replacement shuttle 26' can be readily moved onto the machine track 14.

To assist with changing the shuttles 26, the machine 10 includes a cutter-clamp assembly 48 that is mounted at about the machine track 14 or the base 16. The cutter-clamp assembly 48 moves with the machine track 14 rather than the change system track sections 38. When in use, the cutter-clamp 48 is disposed within the interior of the machine track 14 (within the plane $P_{14}$ of the track 14), but outside of the coil C—that is, between the machine track 14 and/or the shuttle 26 and the coil C. Again, when in use, the cutter-clamp 48 is stationary relative to the track, and is configured to hold or secure (e.g., anchor) a free end of the film F as the shuttle 26 moves about the track 14 when the shuttle 26 begins wrapping film F round the coil C. The cutter-clamp assembly 48 moves into and out of the loop (or the plane $P_{14}$ of the track 14) for use. A clamp element 50 of the cutter-clamp 48 is on the shuttle 26 side or downstream side of the assembly 48 and a cutter element is 52 on the upstream side of the assembly 48 (the side close to the winder 46).

Operation of the machine 10, the wrapping cycle, as well as the shuttle 26 replacement cycle can be controlled by a controller or control system 54 which can be fully automated.

A cycle of the wrapping operation will be discussed with reference to a single wrapping machine 10 with a shuttle change system 12 having one pair of change system track sections 38*a,b*. Also for purposes of the present discussion, the description of the "cycle" will begin with the coil C in the process of being wrapped.

The coil C is loaded on a set of rollers to rotate the coil C. The rollers 56 are positioned such that the eye E of the coil C is aligned with the machine track 14 and the shuttle 26 is traversing around the track 14 wrapping the coil C with the film(s) F (see FIG. 9). The cutter-clamp 48 is positioned (moved) to the side of the machine 10 outside of the plane $P_{14}$ of the track.

The shuttle change assembly 36 is positioned laterally next to the coil C that is being wrapped. At this point in time the shuttle change assembly 36 has one open or empty track 38*b* and a replacement shuttle 26' on the second track 38*a*. The leading end(s) of the film(s) F on the replacement shuttle 26' are held by the winder element 46.

The assembly 36, as set forth above, includes at least a pair of tracks 38*a,b*—more than two tracks can be included, but are not necessary. The assembly 36 height is adjusted (vertical adjustment), by, for example, a motor and lift 58, to match the height of the shuttle system track sections 38 to the height of the machine track 14.

When the shuttle 26 runs out of film(s) F it moves to a home position H which in a present machine is along a portion of the upward curve of the oval, opposite of the arm 20. The home position H is reached by continuing in the forward direction 28 only. The shuttle 26 then continues in the forward direction 28, beyond the location 60 where the arm 20 joins the lower track portion 18, to a position on the lower track portion 18. It will be appreciated that when the shuttle 26 runs out of film(s) F, a film's tail may be left hanging from the coil C. If the tail is hanging and rests on the track, it could get caught under the shuttle and interfere with movement of the shuttle. As such by moving the shuttle 26 in this way, if a tail of the film(s) is left hanging from the coil C, the shuttle 26 will pass under the tail (between the tail and track 14). Accordingly, the tail will rest, if at all, on the top of the shuttle 26. This prevents the tail from becoming caught under the shuttle 26 (in the shuttle wheels 62).

After the shuttle 26 moves into this position, the track hinged section or arm 20 opens. The shuttle assembly 36 moves laterally toward the lower track section 14 to align the empty shuttle track 38*b* with the lower track section 14 and longitudinally to engage the empty shuttle track 38*b* with the machine track 14. The empty shuttle 26 then moves onto the empty track 38*b*.

The assembly 36 then moves longitudinally away from the lower track 14 to disengage from the track 14 and moves laterally to align the replacement shuttle track 38*a* with the lower track section 14. The assembly 36 then moves longitudinally to reengage the tracks 14, 38*a*. The replacement shuttle (not shown) moves onto the machine track 14 into the home position H.

The assembly 36 then again moves longitudinally away from the track 14 to disengage from the track 14 and laterally away from the track 14 so that they are no longer aligned. The arm 20 then pivots back down to engage (and lock into) the track 14. The track 14 is now closed and the shuttle 26' in the home position H. It will be understood that the end of the film(s) is held by the winder 46 and thus extends from the shuttle 26' through the eye E of the coil C, to the winder 46.

Figure 2:
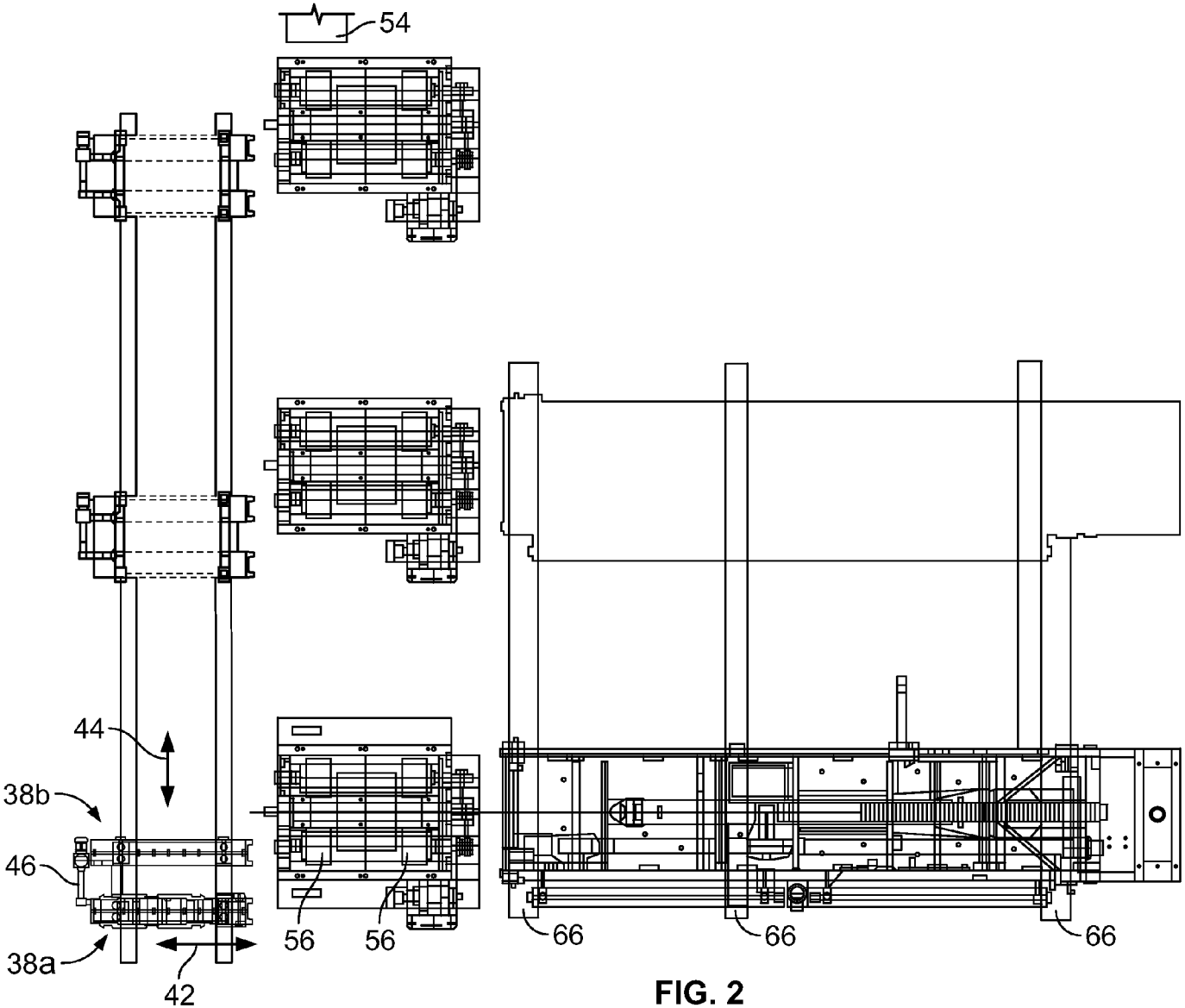
FIG. 2 is a top view of the apparatus of FIG. 1.
Figure 3A:
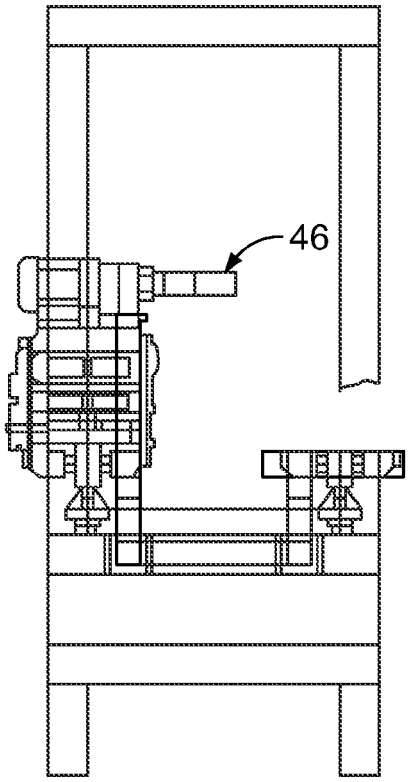
FIGS. 3A-3C are front, side and top views, respectively, it the shuttle change assembly.
Figure 3C:
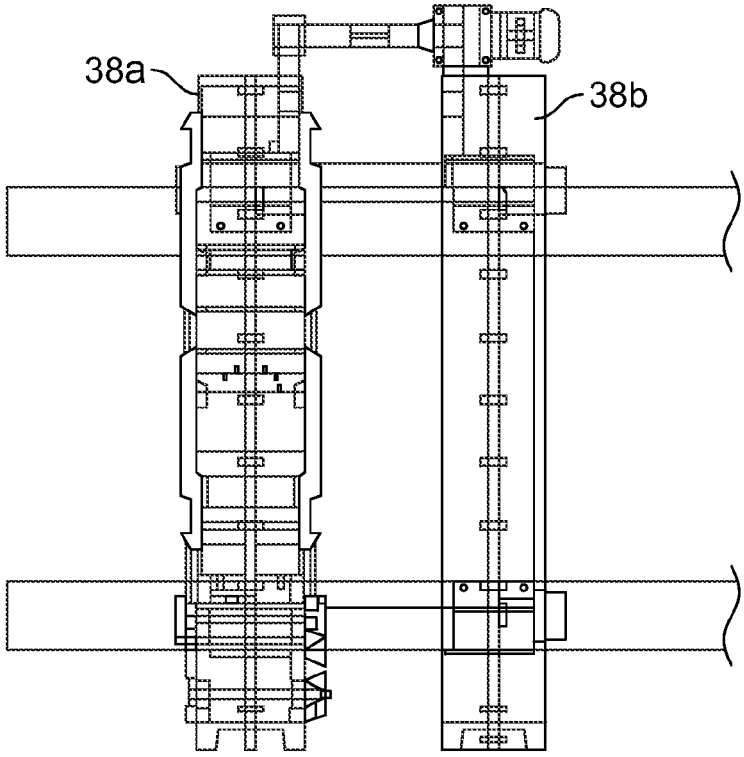
Figure 3B:
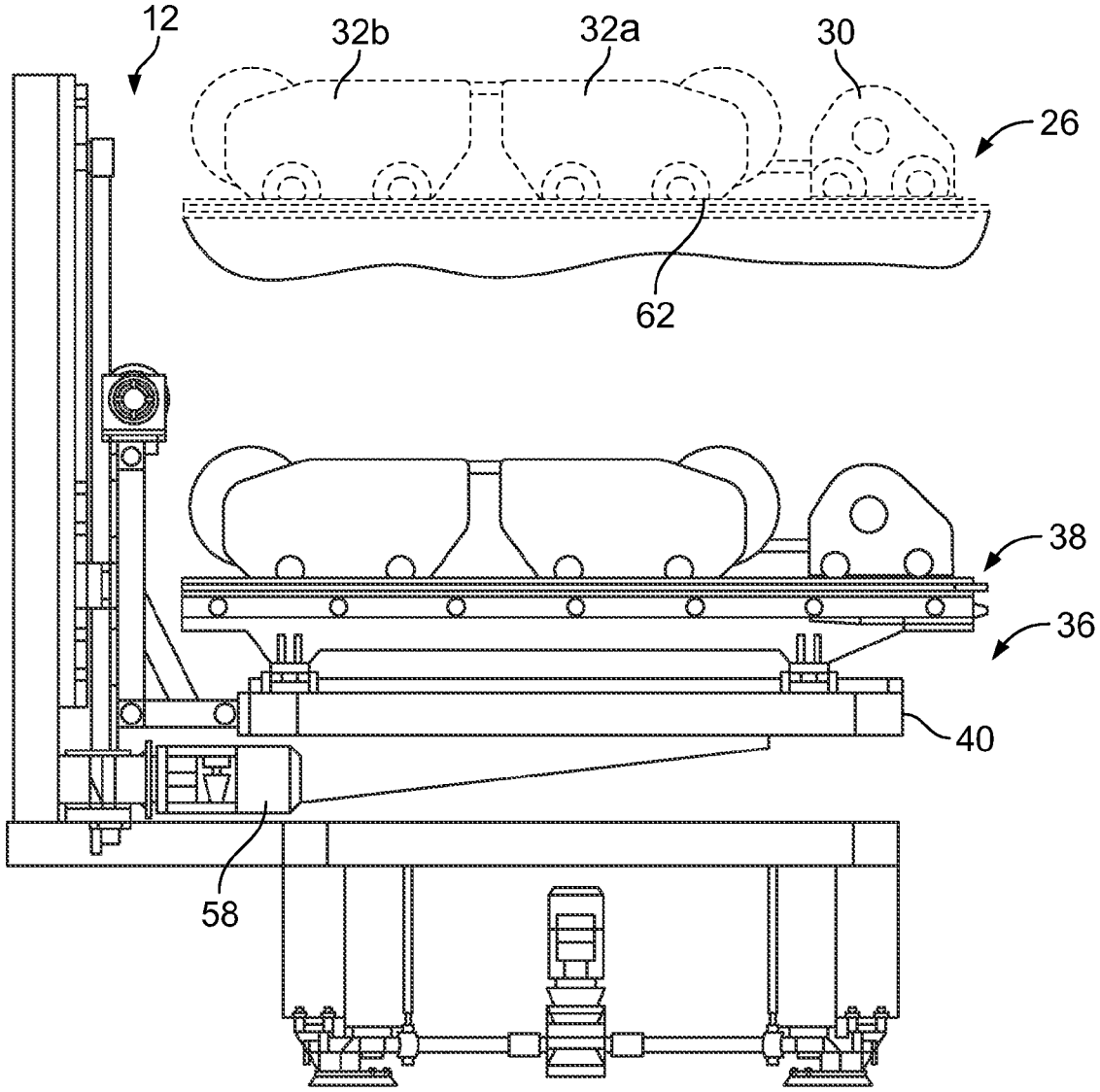
Figure 4:
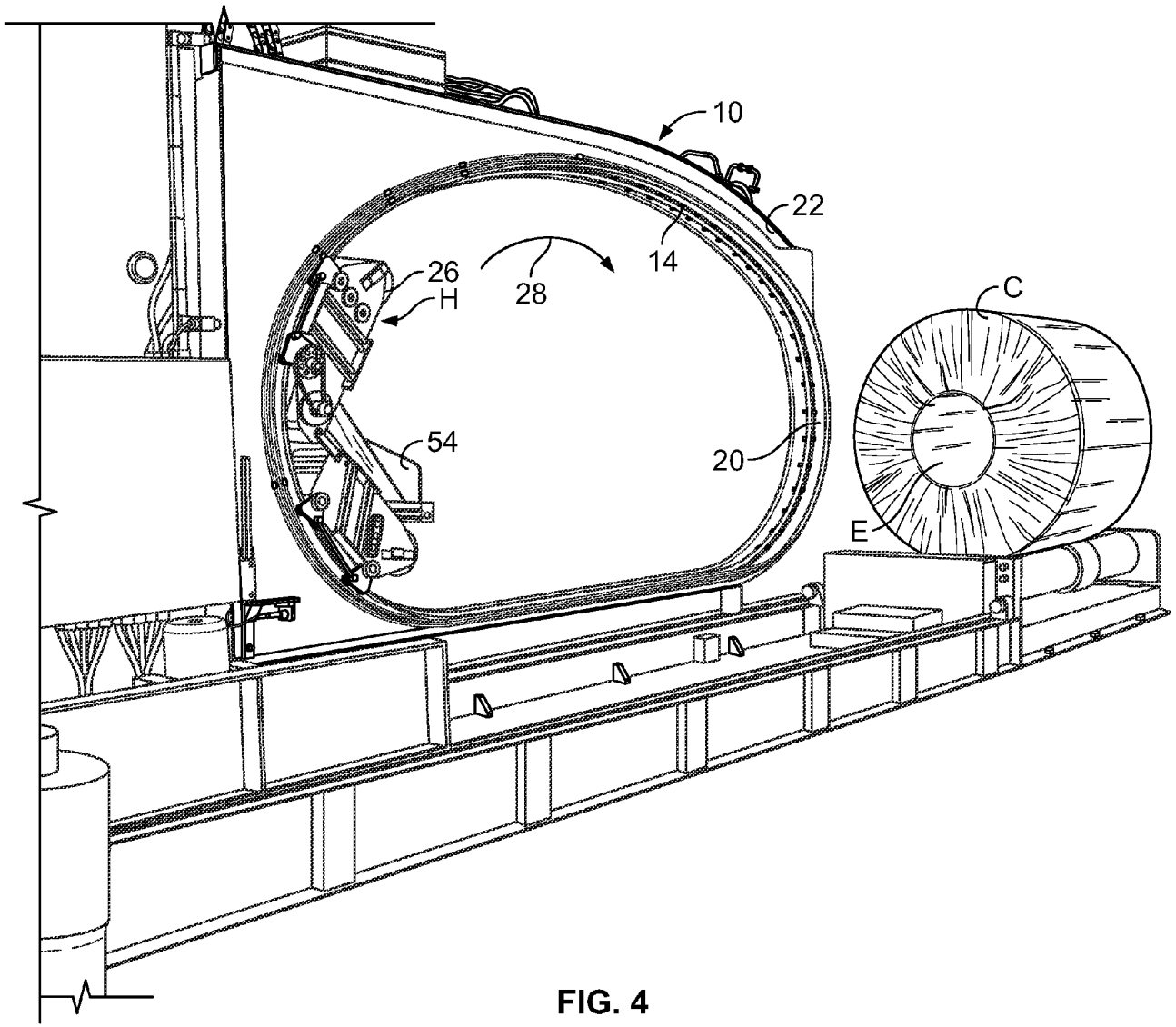
FIG. 4 is a front-side perspective view of the wrapping apparatus with the apparatus being retracted from a wrapped coil.
Figure 5:
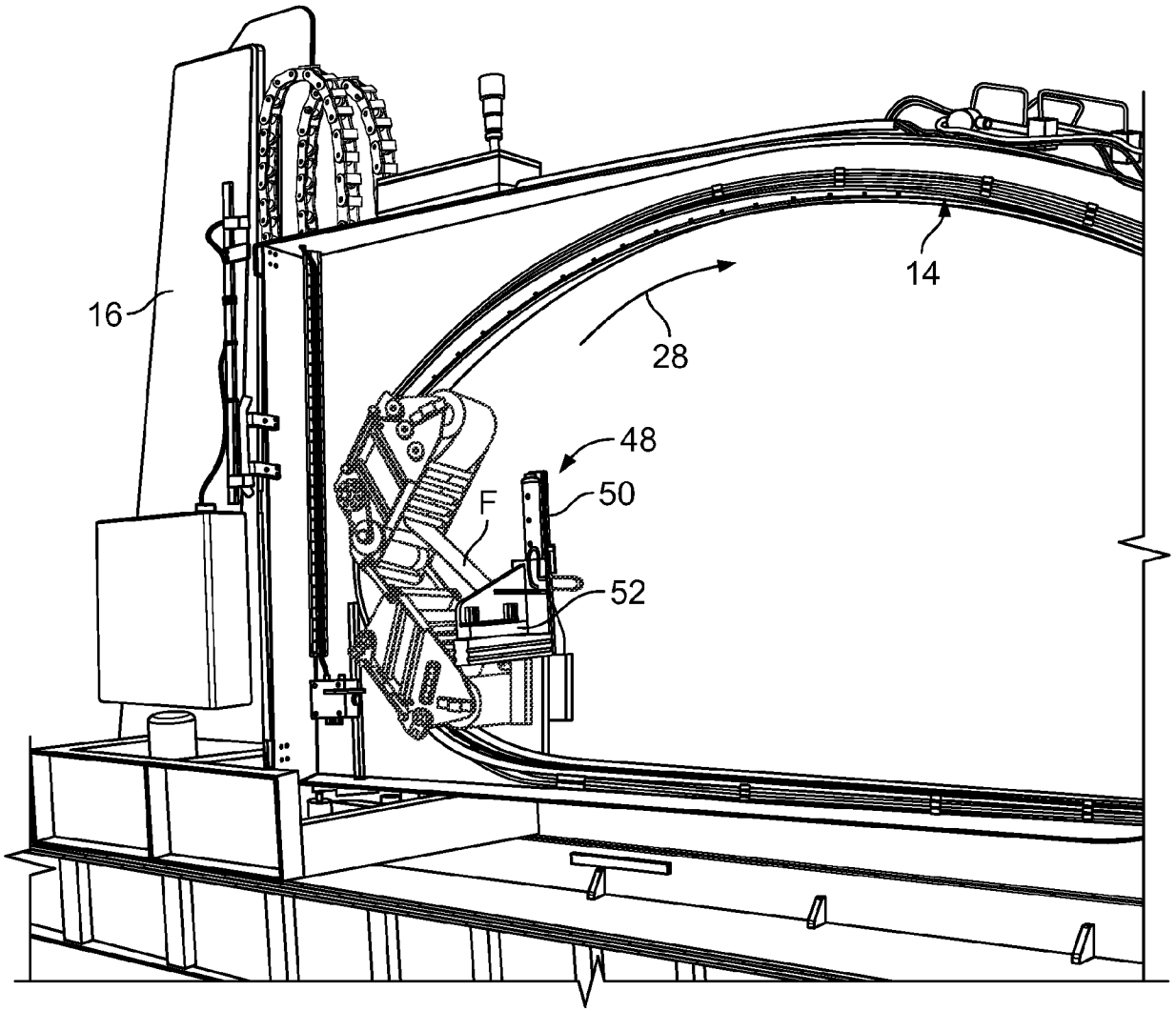
FIG. 5 is a rear-side perspective view of the wrapping apparatus with the shuttle in the home position, with the films clamped in the cutter-clamp and the cutter clamp in the plane of the track.
Figure 6:
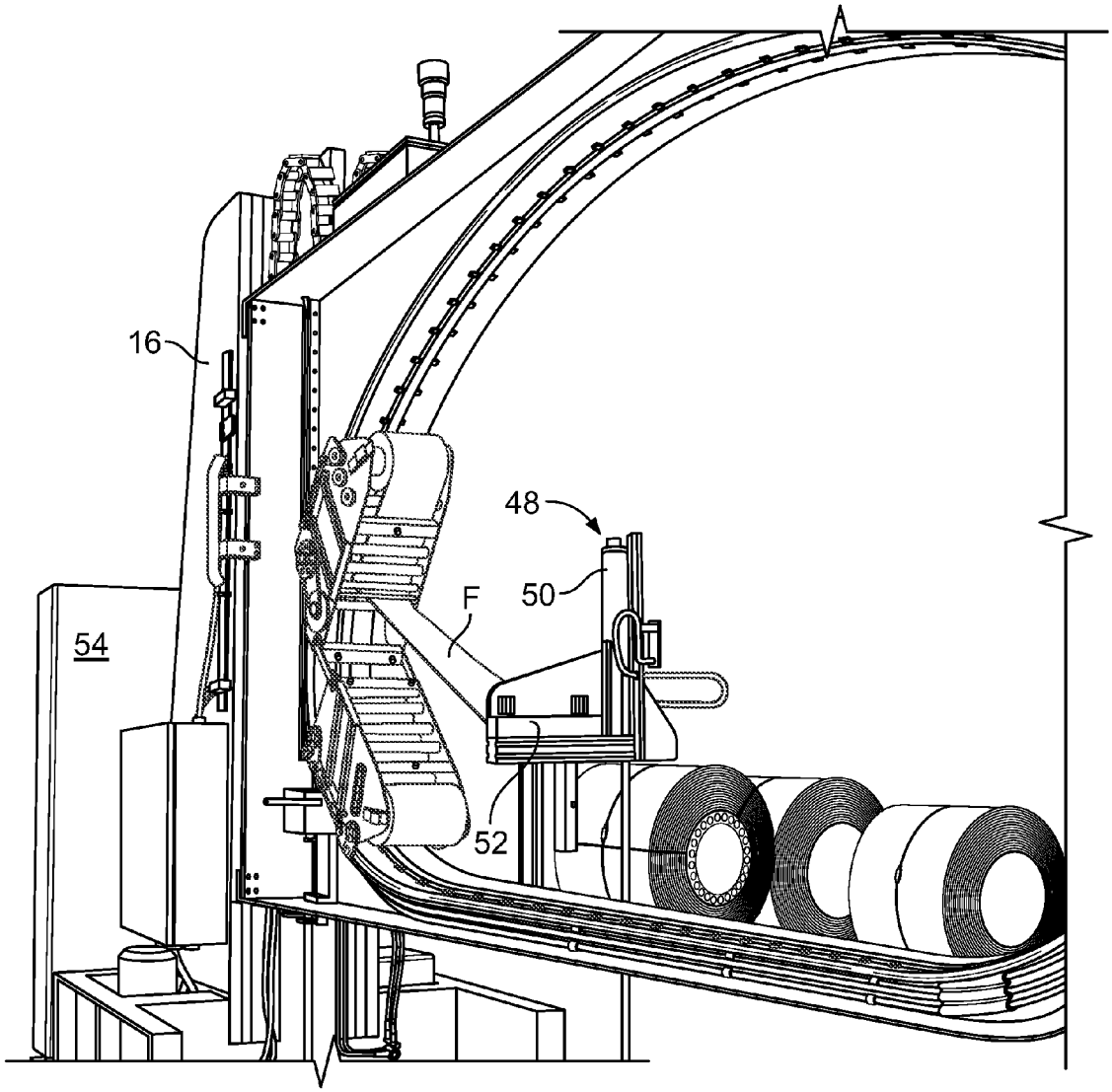
FIG. 6 is also a rear-side perspective view of the wrapping apparatus with the shuttle in the home position, with the films clamped in the cutter-clamp, but with the cutter clamp moved out of the plane of the track.
Figure 7:
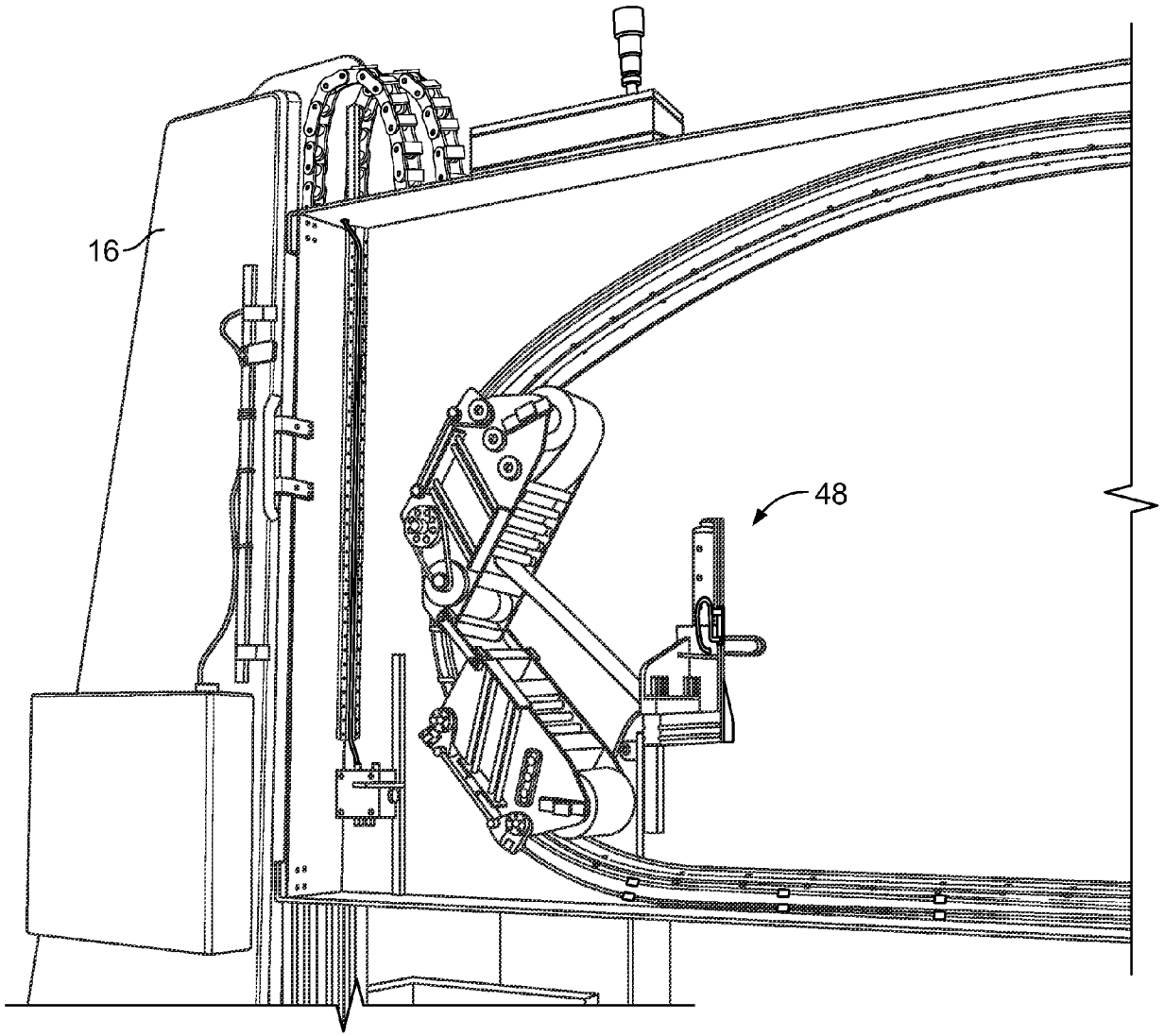
FIG. 7 is more of a side perspective view of the wrapping apparatus showing the shuttle in the home position, this shuttle having a tractor (the drive system) integrated with the trailers (the film dispensers)
Figure 8:
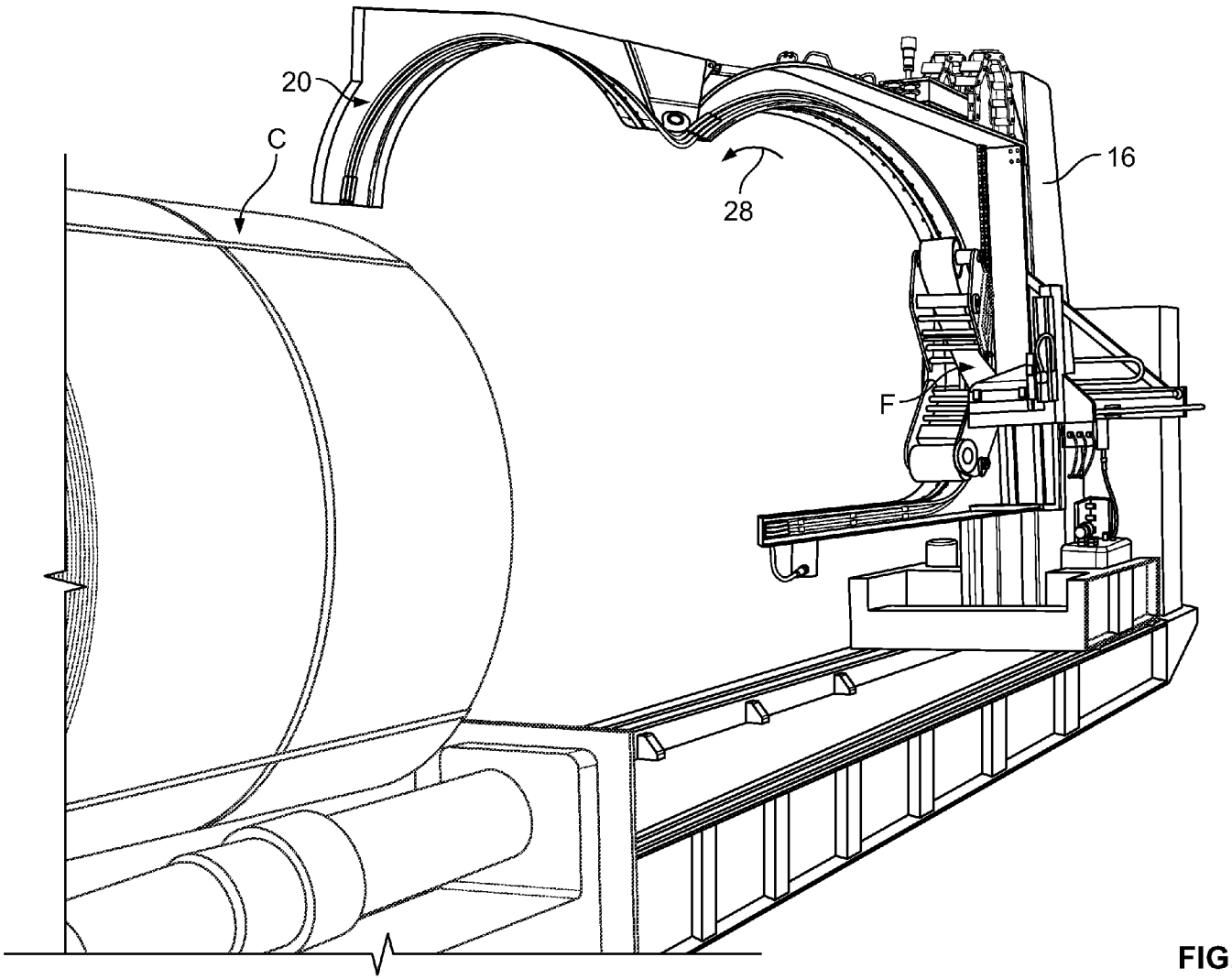
FIG. 8 is a rear-side perspective view of the wrapping apparatus as seen from the side opposite of that shown in FIGS. 4-7, better showing the cutter-clamp assembly.
Figure 9:
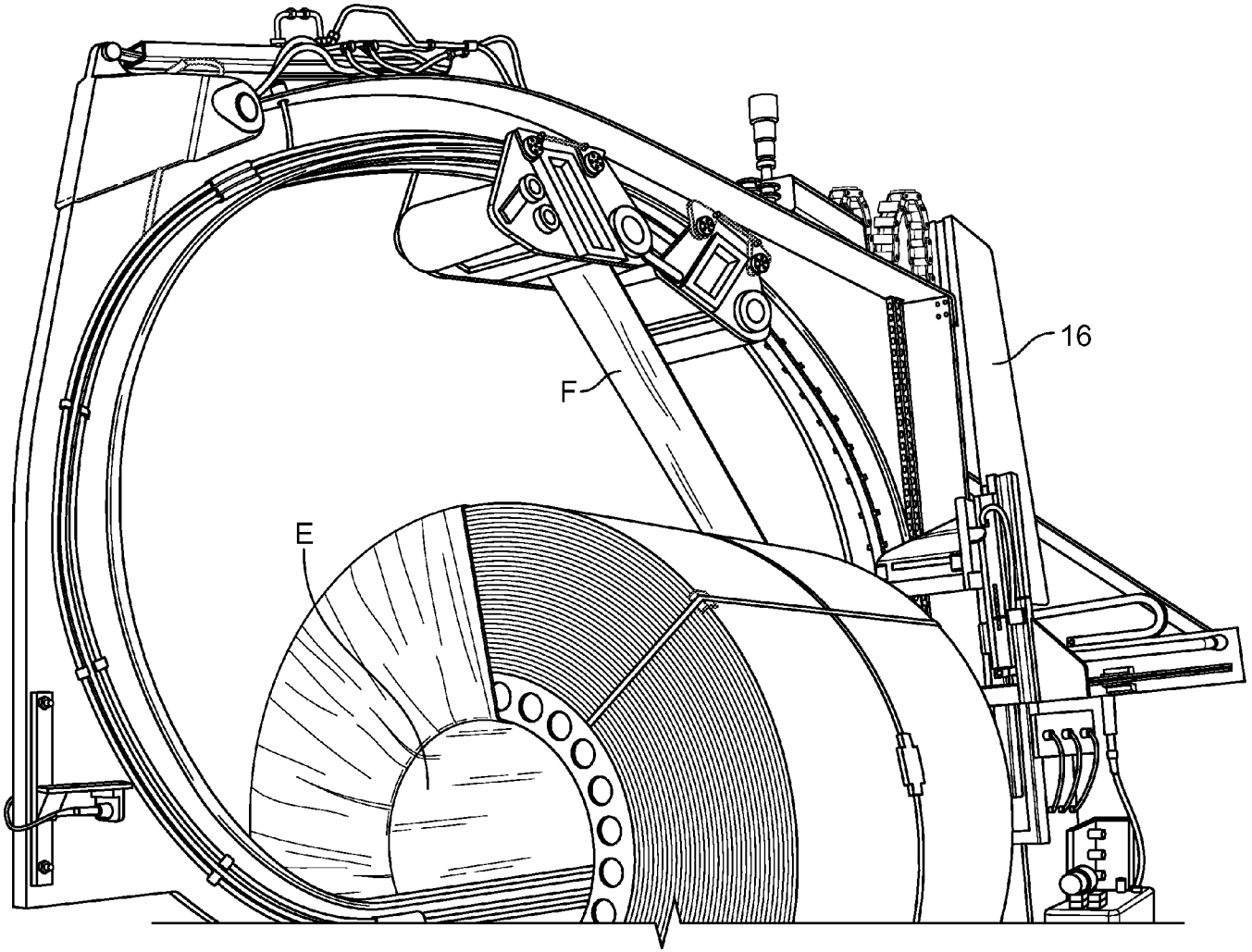
FIG. 9 is a rear-side perspective view of the wrapping apparatus showing the shuttles moving around the track and showing the coil partially wrapped.

The cutter-clamp assembly 48 then moves into place (moves into the plane $P_{14}$ as shown in FIG. 2 of the track 14), such that the films(s) F are in the jaws 54 of the assembly 48. It will be remembered that the cutter 52 is on the winder 46 side of the assembly 48 and the clamp 50 is on the shuttle 26 side of the assembly 48. The cutter element 52 is actuated to sever the feed film(s) F from the cutter clamp 48. The winder 46 is actuated to rewind any tail attached to it back to itself. This clears the coil C eye E for unobstructed shuttle 26' movement.

The shuttle 26' then commences or re-commences wrapping the coil C. After a few seconds of shuttle 26' movement, the cutter-clamp 48 moves out of the plane $P_{14}$ of the track 14. Then, after a predetermined number of winds around the coil C (when it has been determined that the film(s) F will remain on the coil C and will not be pulled off), the clamp element 50 is opened to allow the cycle to continue until the coil C wrap is completed or the shuttle 26' runs out of film(s) F.

It will be appreciated that the present systems 10, 12 anticipate greatly reduced operator time and labor for operation. Accordingly, most if not all of the steps necessary to the above-noted cycle of operation (method) can be carried out automatically using known control systems 54 and methods. In addition, although the machine 10, 12 and operation are described based upon a single wrapping machine 10 that is fixed to a location, the present change system 12 can be used in conjunction with wrapping machines with multiple rollers stations that move (for example, along rails 66) transverse to the track 14 direction. All such variations on the systems 10, 12 are within the scope and spirit of the present invention.

All patents referred to herein, are hereby incorporated herein by reference, whether or not specifically done so within the text of this disclosure.

In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover all such modifications as fall within the scope of the claims.

What is claimed is:

1. A shuttle change system for use in a wrapping apparatus for wrapping an associated item, the wrapping apparatus having an oval track vertically oriented with a cantilevered base portion and an openable portion in the track to move the item into and out of the track, the wrapping apparatus including a shuttle configured for movement along an inner periphery of the track, the shuttle having a wrapping material dispensed therefrom for wrapping around the item, the shuttle change system comprising:

a carrier;

a pair of track sections mounted to the carrier, spaced from one another, the track sections being parallel to one another and each adapted to support a shuttle, wherein the carrier is moveable vertically, longitudinally and laterally to align either of the pair of tracks with the cantilevered base portion of the track, and wherein one of the tracks is adapted to receive a shuttle to be replaced and the other of the tracks is adapted to store a replacement shuttle for movement onto the track, the carrier being movable away from the track to permit the openable track portion to open and close without interference.

2. The shuttle change system of claim 1 wherein the shuttle includes a film dispensing car.

3. The shuttle change system of claim 2 wherein the car dispenses a polymer film.

4. The shuttle change system of claim 2 wherein the car dispenses a fabric wrapping member.

5. The shuttle change system of claim 1 wherein the shuttle includes a drive and a film dispensing car, the car being pulled by the drive.

6. The shuttle change system of claim 1 wherein the shuttle includes a drive and a pair of film dispensing cars, the cars being pulled by the drive and wherein one of the pair of cars dispenses a polymer film and another of the pair of cars dispenses a fabric.

7. The shuttle change system of claim 1 wherein the openable portion of the track is moved to effect change of the shuttle.

8. The shuttle change system of claim 1 wherein the shuttle change system includes at least a pair of side-by-side track sections.

9. The shuttle change system of claim 8 wherein the at least a pair of track sections are positioned so as to extend forward of a lower portion of machine track.

10. The shuttle change system of claim 8 wherein the track sections have a shared winder element, the winder element configured to remove excess film from the machine track.

11. The shuttle change system of claim 1 wherein the shuttle change system is adjustable in a plurality of planes.

12. The shuttle change system of claim 1 wherein the shuttle change system is mounted to a carrier that is adjustable in a plurality of planes.

13. The shuttle change system of claim 1 wherein a cutter-clamp assembly is configured to secure a free end of the film as the shuttle moves about the machine track.

14. The shuttle change system of claim 1 wherein the shuttle change system is controlled by a controller.

15. A method for changing a shuttle, the shuttle for use in a wrapping apparatus for wrapping an associated item, the wrapping apparatus having an oval track vertically oriented with a cantilevered base portion and an openable portion in the oval track to move the item into and out of the oval track, the wrapping apparatus including a shuttle configured for movement along an inner periphery of the oval track, the shuttle having a wrapping material dispensed therefrom for wrapping around the item, the method for changing the shuttle comprising the steps of:

opening the openable portion of the oval track;

aligning a vacant shuttle change track of a shuttle change system with the cantilevered base portion of the wrapping apparatus;

removing a first shuttle from the oval track and loading onto the vacant shuttle change track; and loading a second shuttle onto the wrapping apparatus from a second shuttle change track.

16. The method for changing a shuttle of claim 15 further comprising the step of removing excess film from the machine track.

17. The method for changing a shuttle of claim 15 further comprising the step of holding a leading edge of the film by a winder element.

* * * * *